US012089629B2

(12) United States Patent
Giannini et al.

(10) Patent No.: US 12,089,629 B2
(45) Date of Patent: Sep. 17, 2024

(54) METHOD AND APPARATUS FOR FOLDING A WEB OF MATERIAL

(71) Applicant: PHILIP MORRIS PRODUCTS S.A., Neuchatel (CH)

(72) Inventors: Antonella Giannini, Bologna (IT); Stefano Malossi, Bologna (IT); Alberto Monzoni, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 415 days.

(21) Appl. No.: 16/967,837

(22) PCT Filed: Jan. 18, 2019

(86) PCT No.: PCT/EP2019/051297
§ 371 (c)(1),
(2) Date: Aug. 6, 2020

(87) PCT Pub. No.: WO2019/158313
PCT Pub. Date: Aug. 22, 2019

(65) Prior Publication Data

US 2021/0392946 A1 Dec. 23, 2021

(30) Foreign Application Priority Data

Feb. 15, 2018 (EP) ..... 18157005

(51) Int. Cl.
*A24D 3/02* (2006.01)
*A24D 3/04* (2006.01)
*A24D 3/17* (2020.01)

(52) U.S. Cl.
CPC ..... *A24D 3/0245* (2013.01); *A24D 3/0233* (2013.01); *A24D 3/0258* (2013.01); *A24D 3/043* (2013.01); *A24D 3/17* (2020.01)

(58) Field of Classification Search
CPC ... A24D 3/0233; A24D 3/0245; A24D 3/0258
See application file for complete search history.

(56) References Cited

U.S. PATENT DOCUMENTS 2,001,709 A * 5/1935 Davidson ..... A24D 3/0245 156/227
2,164,702 A 7/1939 Davidson
(Continued)

FOREIGN PATENT DOCUMENTS

EP 0307686 3/1989
EP 0482283 6/1995
(Continued)

OTHER PUBLICATIONS

Machine Translation of EP 1925219 (Year: 2008).*
(Continued)

*Primary Examiner* — Russell E Sparks
(74) *Attorney, Agent, or Firm* — Mueting Raasch Group

(57) ABSTRACT

A method of manufacturing a compressed rod of web material for the filter rod of an aerosol-generating article, comprising: supplying a feed of web material from a supply apparatus; drawing the web material through a filter rod manufacturing apparatus; introducing a curved ridge into the central portion of the width wise cross-section of the web material as it approaches contact with the interior of a folding funnel, by drawing the web material across a forming surface of a former that contacts a central portion of the web material, in which the forming surface deflects the central portion of the web material from a line extending between where the web material leaves the supply apparatus and the center of an outlet of the folding funnel; and folding the web material in the folding funnel to form a compressed rod of web material.

11 Claims, 8 Drawing Sheets

(56) References Cited

U.S. PATENT DOCUMENTS

| | | | | | |
|---|---|---|---|---|---|
| 4,281,671 | A | | 8/1981 | Bynre | |
| 4,632,130 | A | * | 12/1986 | Heitmann | A24C 5/1821 131/84.1 |
| 4,807,809 | A | | 2/1989 | Pryor | |
| 5,024,241 | A | * | 6/1991 | Hulsman | A24C 5/1807 131/365 |
| 5,137,034 | A | * | 8/1992 | Perfetti | A24B 15/165 131/194 |
| 5,615,693 | A | | 4/1997 | Saitoh | |
| 7,547,271 | B2 | | 6/2009 | Kato | |
| 2014/0243178 | A1 | | 8/2014 | Matern | |

FOREIGN PATENT DOCUMENTS

| | | | | | |
|---|---|---|---|---|---|
| EP | 1925219 | A2 | * | 5/2008 | A24C 5/18 |
| GB | 1592952 | | | 7/1981 | |
| JP | S53091199 | | | 8/1978 | |
| JP | S55-58084 | | | 4/1980 | |
| JP | H01-243979 | | | 9/1989 | |
| JP | H04-158776 | | | 6/1992 | |
| JP | H06-327457 | | | 11/1994 | |
| JP | H08-214854 | | | 8/1996 | |
| JP | H11-169152 | | | 6/1999 | |
| JP | H11-318418 | | | 11/1999 | |
| WO | WO 2005/087026 | | | 9/2005 | |

OTHER PUBLICATIONS

PCT Search Report and Written Opinion for PCT/EP2019/051661 dated May 3, 2019 (10 pages).

Extended European Search Report for Application No. 18157005.2 dated Aug. 28, 2018 (7 pages).

Office Action issued in Japan for Application No. 2020-543623 dated Mar. 13, 2023 (5 pages). English translation included.

* cited by examiner

METHOD AND APPARATUS FOR FOLDING A WEB OF MATERIAL

This application is a U.S. National Stage Application of International Application No. PCT/EP2019/051297 filed Jan. 18, 2019, which was published in English on Aug. 15, 2019 as International Publication No. WO 2019/158313 A1. International Application No. PCT/EP2019/051297 claims priority to European Application No. 18157005.2 filed Feb. 15, 2018.

The present invention relates to folding a web of material into a rod-shape, and more particularly, to manufacturing filter rods for aerosol-generating articles.

The material forming the web may be, but is not limited to a homogenized tobacco material, for example TCL (tobacco cast leaf), which is dried and cut into foils or sheets that are wound-up onto bobbins for storage and transport. Similarly, the material forming the web may be PLA (poly lactic acid).

In a typical manufacturing process for aerosol-generating articles, a web of material goes through a crimping process, in which it is passed between two rollers having complementary ridge-and-trough-shaped surface profiles that press on the web of material, to crimp the web. The crimped web is then compressed into a rod, for example by passing the web through a funnel-shaped web pre-forming apparatus, e.g. a frustoconical tube, having an outlet with a diameter that is many times smaller in diameter than the width of the web of material. This induces many folds into the web, as the web is gathered and compressed into a rod shape. The folds in the web are referred to here as pleats. The compressed rod is cut into sections, usually tubular sections, which may form components of aerosol-generating articles.

The pattern of pleating that is created as the web passes through the funnel-shaped pre-forming apparatus is a function of several operational parameters. Some of these parameters may not be fully controlled, or may even vary randomly, resulting in variation in the pleating pattern along the length of the resultant compressed rod of the web material.

The pattern of pleating may be a function of the position of the web relative to the pre-forming apparatus, as this affects which parts of the web (across its width) come into contact with the inner surface of the pre-forming apparatus. Contact between the web and the inner surface applies local frictional forces to the web, slowing corresponding portions of the web, and causing the web to steer itself into a different position relative to the pre-forming apparatus, where a different pattern of contact is formed between the web and the inner surface of the pre-forming apparatus. This variation in the web position relative to the pre-forming apparatus, as the web is drawn through the pre-forming apparatus, causes variation in the pattern of contact between the web and the pre-forming apparatus, so causing variation in the web pleating pattern, along the length of the web as it passes through the pre-forming apparatus.

Physical contact between the web and the pre-forming apparatus may cause local changes in physical properties of the web, which may adversely affect performance of the resultant aerosol-generating article, and which it may be desirable to minimize. For example, frictional contact between the web and the pre-forming apparatus, may cause static discharge or heating of the web, and corresponding surface contraction of the web material. Physical contact between the web and the pre-forming apparatus may affect the thickness of the web. Physical contact between the web and the pre-forming apparatus may affect the web flexibility. Additionally, physical changes in the web arising from physical contact between the web and the pre-forming apparatus may vary undesirably along the length or across the width of the web.

Variation in the web pleating pattern and material properties of the web may cause variation in performance of the compressed rods across a production run of aerosol-generating articles.

U.S. Pat. No. 4,807,809 discloses a pre-forming apparatus for pleating a web of material, in which a frustoconical member is coaxially positioned within, and closely spaced apart from, a frustoconical tube, providing an annular gap that reduces in diameter towards an outlet. The patent describes that control over the pleating pattern of a web of material passing through the pre-forming apparatus may be provided by controlling the size of the annular gap. However, the relative position of the web and the pre-folding apparatus remains subject to variation. Additionally, the described apparatus is mechanically complex and inconvenient to clean or service.

According to a first aspect, there is provided a method of manufacturing a compressed rod of web material for the filter rod of an aerosol-generating article, comprising: supplying a feed of web material from a supply apparatus; drawing the web material through a filter rod manufacturing apparatus; introducing a curved ridge into the central portion of the width wise cross-section of the web material as it approaches contact with the interior of a folding funnel, by drawing the web material across a forming surface of a former that contacts a central portion of the web material in which the forming surface deflects the central portion of the web material from a line extending between where the web material leaves the supply apparatus and the centre of an outlet of the folding funnel; and folding the web material in the folding funnel to form a compressed rod of web material.

According to a second aspect, there is provided a method of manufacturing a filter rod for an aerosol-generating article, comprising the method of manufacturing a compressed rod of the first aspect, and wrapping the compressed rod of web material within a tube of wrapping paper.

According to a third aspect, there is provided a folding apparatus for folding a web material into a rod-shape that extends along the length of the web material, for the manufacture of filter rods for aerosol-generating articles, comprising: a folding funnel for folding the web material into a rod-shape, the folding funnel having an inlet and an outlet that is narrower than the inlet; a supply apparatus for supplying the web material into the inlet of the folding funnel; and a former provided between the supply apparatus and the outlet of the folding funnel for introducing a curved ridge into a central portion of the width wise cross-section of the web material drawn across the former when passing from the supply apparatus and through the folding funnel, the former having a forming surface to contact the sheet material, wherein the former is positioned for the forming surface to deflect a central portion of a web material from a line extending between where the web material is configured to leave the supply apparatus and the centre of an outlet of the folding funnel.

According to a fourth aspect, there is provided a filter rod manufacturing apparatus for manufacturing a filter rod for an aerosol-generating article, comprising: the folding apparatus of the third aspect; a tensioning and drive mechanism for drawing the web material through the filter rod manufacturing apparatus and maintaining a consistent tension in the web material as the web material is drawn into the folding funnel; and a wrapping apparatus for wrapping the compressed rod within a tube of wrapping paper.

The web material may be deflected by a deflection distance of 20 mm to 60 mm, at the peak of the curved central ridge, where the web material passes over the forming surface.

The relative positions of the former and folding funnel may be adjustable for adjusting the deflection distance of the web material.

The forming surface may be located 20 mm to 200 mm from the mouth of the folding funnel. The forming surface may be located 30 mm to 150 mm from the mouth of the folding funnel.

The forming surface may be located within the folding funnel.

The former may extend into the mouth of the folding funnel.

The forming surface may be a smoothly curved surface.

The forming surface may be provided with a textured surface.

The textured surface may have a plurality of ridges extending along the direction of travel of the web material.

The former may be provided with a temperature control mechanism.

The forming surface may be provided with a plurality of air supply holes.

The forming surface may be provided on a convex surface having a radius of curvature of 25 mm.

A curved W-shape may be produced in the web material where it is drawn across the former. The orientation of the curved W-shape that is produced may be subject to the relative positioning of the funnel, former and supply apparatus. The curved W-shape has a curved central ridge, which may project upwardly, downwardly (corresponding to an inverted W-shape), laterally, or at another angle, in correspondence with the orientation of the curved W-shape produced. For example, where the web material is drawn across the former, the web material may be shaped by the former and funnel to have a central local maximum position and two adjacent minima either side thereof. Similarly, the web material may also be shaped by the former and funnel to have the inverse pattern, i.e. a central local minimum position and two adjacent maxima either side.

The central portion of the width-wise cross-section of the web material may be the central 50% of the width of the web material.

As used herein, the term "curved central ridge" of the web refers to a ridge with a peak that is located within the central 50% of the width of the web, and preferably within the central 20% of the width of the web, and which has a radius of curvature of the concave surface that is at least ten times greater than the thickness of the web, and preferably at least twenty times greater than the thickness of the web.

As used herein, the terms "sheet", "web material" or "web" denote a laminar element having a width and length substantially greater than the thickness thereof. The width of a sheet is preferably greater than about 10 millimetres, more preferably greater than about 20 millimetres or 30 millimetres. Even more preferably, the width of the sheet is comprised between about 100 millimetres and about 300 millimetres.

In a preferred embodiment, the web comprises polylactic acid (PLA). The sheet may be a sheet of a material containing alkaloids. The sheet may be a sheet comprising homogenised tobacco material.

A "material containing alkaloids" is a material which contains one or more alkaloids. Among alkaloids, nicotine is a preferred one, which can be found in tobacco. Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus. Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

A commonly used form of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example, by casting a viscous slurry onto a moving belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then typically casted, extruded, rolled or pressed to form a sheet material. The sheet of tobacco can be formed utilizing a wet process, where tobacco fines are used to make a paper-like material; or a cast leaf process, where tobacco fines are mixed together with a binder material and cast onto a moving belt to form a sheet. The sheet of homogenized tobacco material may then be rolled in bobbins which are unwound in order to be further processed, to be part for example of an aerosol generating article, that is to be included in the aerosol-forming substrate of the aerosol generating article. A "heat-not-burn" aerosol generating article is a aerosol-generating article wherein an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol generating article. This means that the aerosol composition that is generated by such a "heat-not-burn" aerosol generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former. This composition may lead to a sheet which is "sticky", that is, it glues to adjacent objects, and at the same time it is rather fragile having a relatively low tensile strength.

As used herein, the term "crimped" denotes a sheet or web with a plurality of corrugations. The term "crimping" denotes the formation of a crimped sheet of material, preferably from an essentially flat sheet of material or a previously untreated sheet of material with respect to generating a structured surface.

As used herein, the term "supply apparatus" denotes a device for supplying, to the former, a web of material for folding in the folding funnel. The web may be supplied directly from a bobbin wound with the web, which is positioned relative to the former and funnel to provide deflection of the web as it passes across the former. The web may be supplied from a source via intermediary stages, that may include crimping, tensioning and a final alignment stage to supply the web to the former.

As used herein, the term "former" denotes a device providing a web-contacting surface that forms a curved ridge in the web as it is deflected by sliding across the web-contacting surface. The former may have a single convex web-contacting surface for forming the curved ridge into the web.

As used herein, the term "rod" denotes a generally cylindrical element of substantially circular or oval cross-section.

As used herein, the terms "axial" or "axially" refer to a direction extending along, or parallel to, the cylindrical axis of a rod.

As used herein, the terms "gathered" or "gathering" denote that a web or sheet is convoluted, or otherwise compressed or constricted substantially transversely to the cylindrical axis of the rod.

In the manufacturing process of the aerosol generating articles, the sheet of material may be subjected to a crimping process.

During the crimping process, the sheet of material is usually pressed between two rotating cylindrical rollers, also called "crimping rollers". These rollers have matching textured ridges/grooves patterns on their outside surfaces that crimp the sheet of material. However, any crimping process may be use in the present invention.

The crimping process forms corrugations on the sheet of material. Due to the crimping, preferably the structure of the sheet material is selectively weakened. Where the sheet material is fibrous, the crimping process may induce weaknesses into the material by breaking some of the fibres of the material. This breakage preferably helps to compress the web of material into a rod. In particular, crimping may elongate the material to form longitudinal weakened lines of preferred folding. These lines are called corrugations.

The steps of compressing the web into a rod-shape are stable and can be easily reproduced, which may help to reach consistency in the compression of the web into a rod and thus to reach consistency also in the final product.

The forming surface may be a textured surface. Advantageously, a textured surface may further decrease friction between the forming surface and the web of material. The forming surface may be provided with a textured surface having a pattern of ridges. The forming surface may be provided with an arrangement of air supply holes, out through which a supply of air may be provided.

Examples are further described hereinafter with reference to the accompanying drawings, in which.

In the described examples, like features have been identified with like numerals, albeit in some cases having one or more of increments of integer multiples of 100. For example, in different figures, 120, 220, 320, 420 and 520 have been used to indicate a funnel.

Figure 1A:
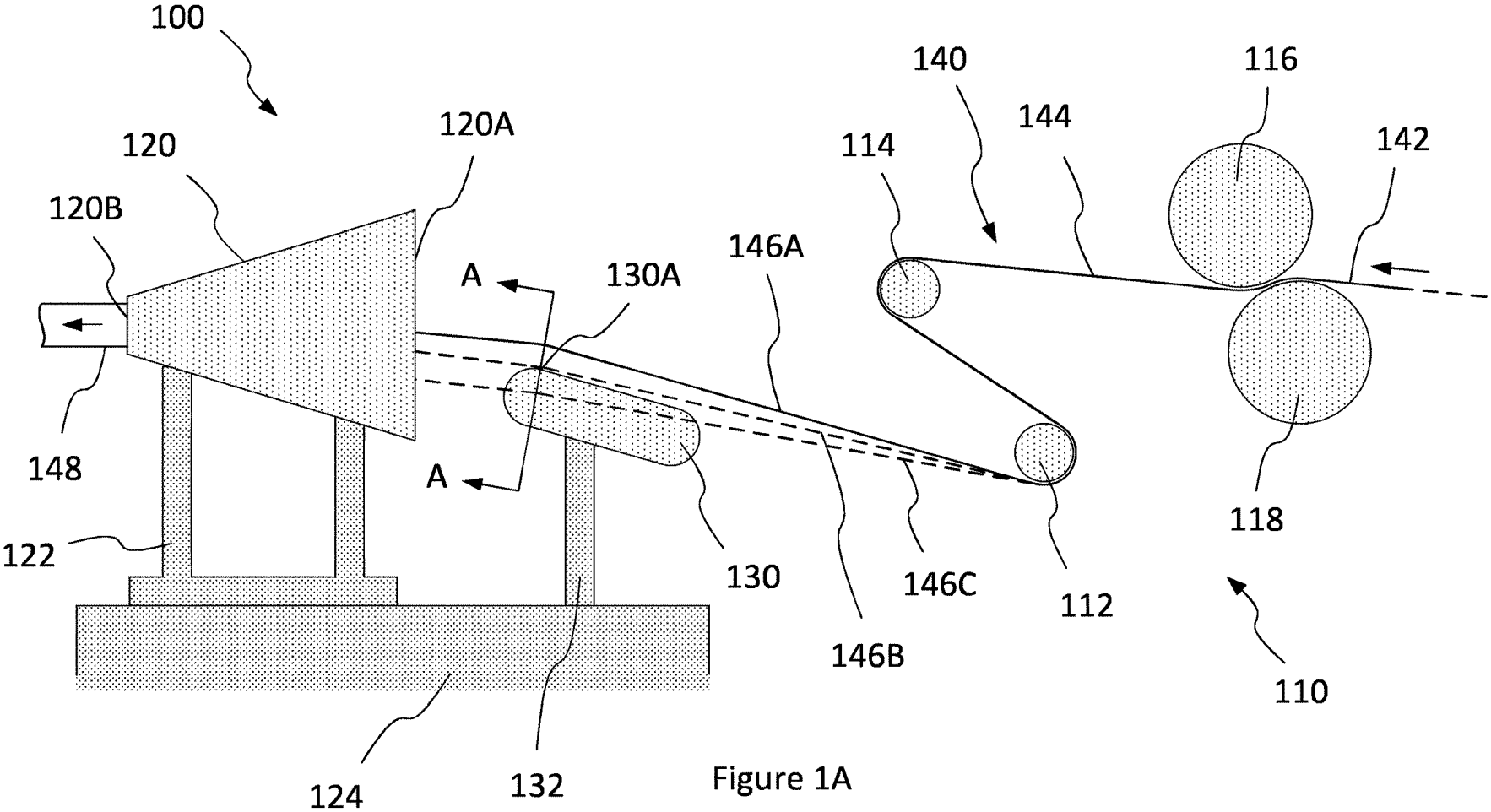
FIG. 1A shows a side view of a first folding apparatus for folding a web into a rod-shape.

FIG. 1A shows a side view of a first folding apparatus 100 for folding a web (which may also be referred to as a web material) into a rod-shape, having a supply apparatus 110, a folding funnel 120 and a former 130, for folding a web of material 140 into a compressed rod 148. In use, the path of the web 140 is deflected by being drawn across the former 130, as it is fed from the supply apparatus 110 into the funnel 120, which introduces a curved ridge 146B into the width-wise cross-section of the web. The peak of the curved ridge is provided in a central portion (central half) of the width-wise cross-section of the web.

The illustrated exemplary supply apparatus 110 comprises a guide roller 112, a tension roller 114 and crimping rollers 116, 118, to which the web 140 is fed from a source (not shown), for example being supplied from a bobbin, onto which the web is wound. The web supplied by the source is typically un-patterned 142. The crimping rollers 116, 118 are provided with a textured surface pattern (e.g. complementary ridge-and-trough surface patterns), and introduce a corresponding crimped pattern into the web 140 as it passes between them, forming a crimped web 144. The tension roller 114 (if provided) maintains a constant tension in the web 140 as it is fed to the funnel 120, and may be mounted on a resiliently deformable mount, e.g. a spring-mount.

In an alternative arrangement, some or all of the guide roller, tension roller and crimping rollers may be omitted from the supply apparatus, with the source of web (e.g. a bobbin) being provided where the guide roller 112 is illustrated in FIG. 1A, causing the web to deflect across the former 130 as it is fed from the source of the supply apparatus to the funnel 120.

The web 140 is ribbon-shaped and flexible, and may comprise polylactic acid (PLA) or homogenised tobacco material, amongst others. The web 140 may have a thickness of 0.3 to 0.6 millimetres, and a width of 100 to 300 millimetres.

The relative positioning of the outlet 112 of the supply apparatus 110 (which is the guide roller 112 in FIG. 1A), the funnel 120 and the former 130 is arranged to cause the path of the web 140 to deflect as the web is drawn across the former.

In FIG. 1A, the web-contacting surface 130A of the former 130 is provided in front of the mouth 120A of the funnel 120.

Figure 1B:
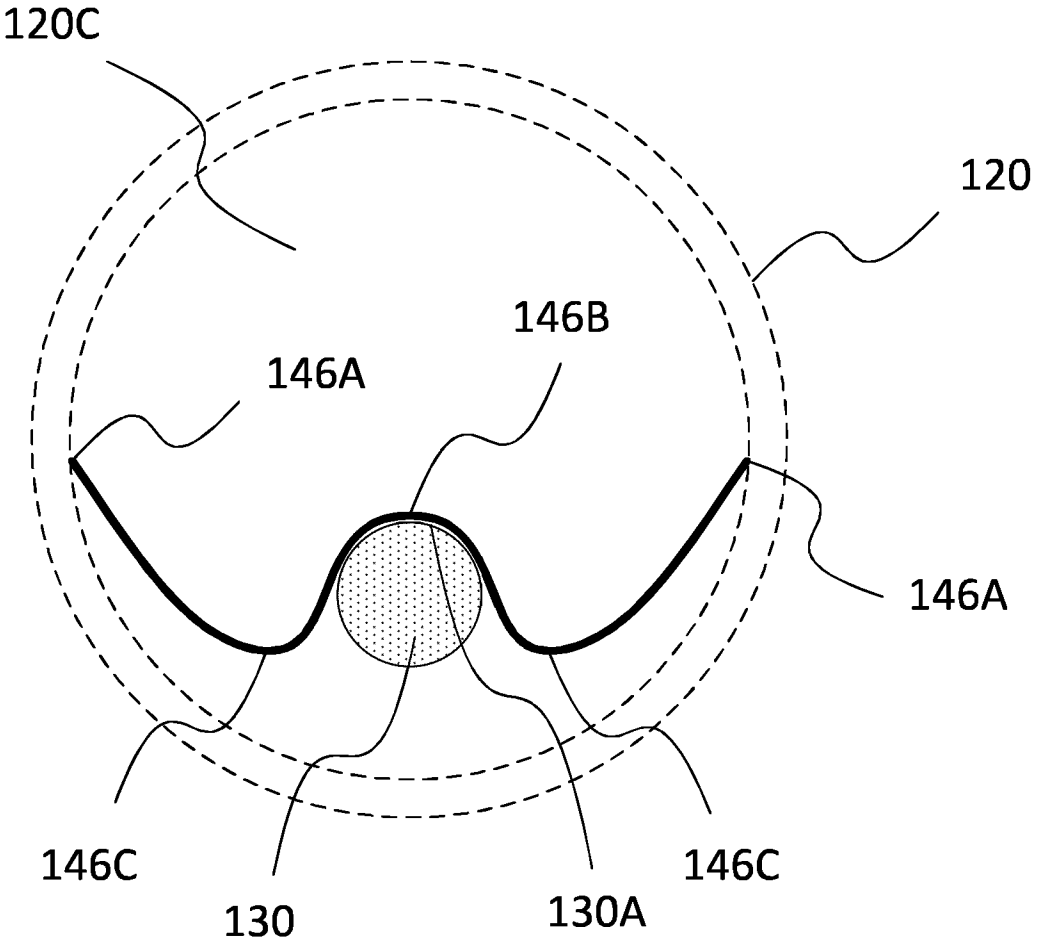
FIG. 1B shows a cross-sectional view through the first folding apparatus at the line indicated A-A in FIG. 1A.

Deflecting the web 140 across the former 130 introduces a curved central ridge 146B into the width-wise cross-section of the web, as shown in FIG. 1B. Contact with the inner surface 120C of the funnel 120 causes the lateral portions of the web 140, adjacent the edges 146A, to curl upwards, providing a valley 146C region on each side of the curved central ridge 146B. The relative positioning of the funnel 120, former 130 and supply apparatus 110 produces the curved-W-shaped cross-sectional shape of the web 140 shown in FIG. 1B. The extent to which the edges 146A of the web 140 are raised, producing the valleys 146C either side of the curved central ridge 146B may vary with the proximity of the former 130 to the location at which the web first makes contact with the inner surface 120C of the funnel 120. For example, the lateral portions of the web may be relatively flat on either side of the curved central ridge when the former is further from the funnel.

Figure 1C:
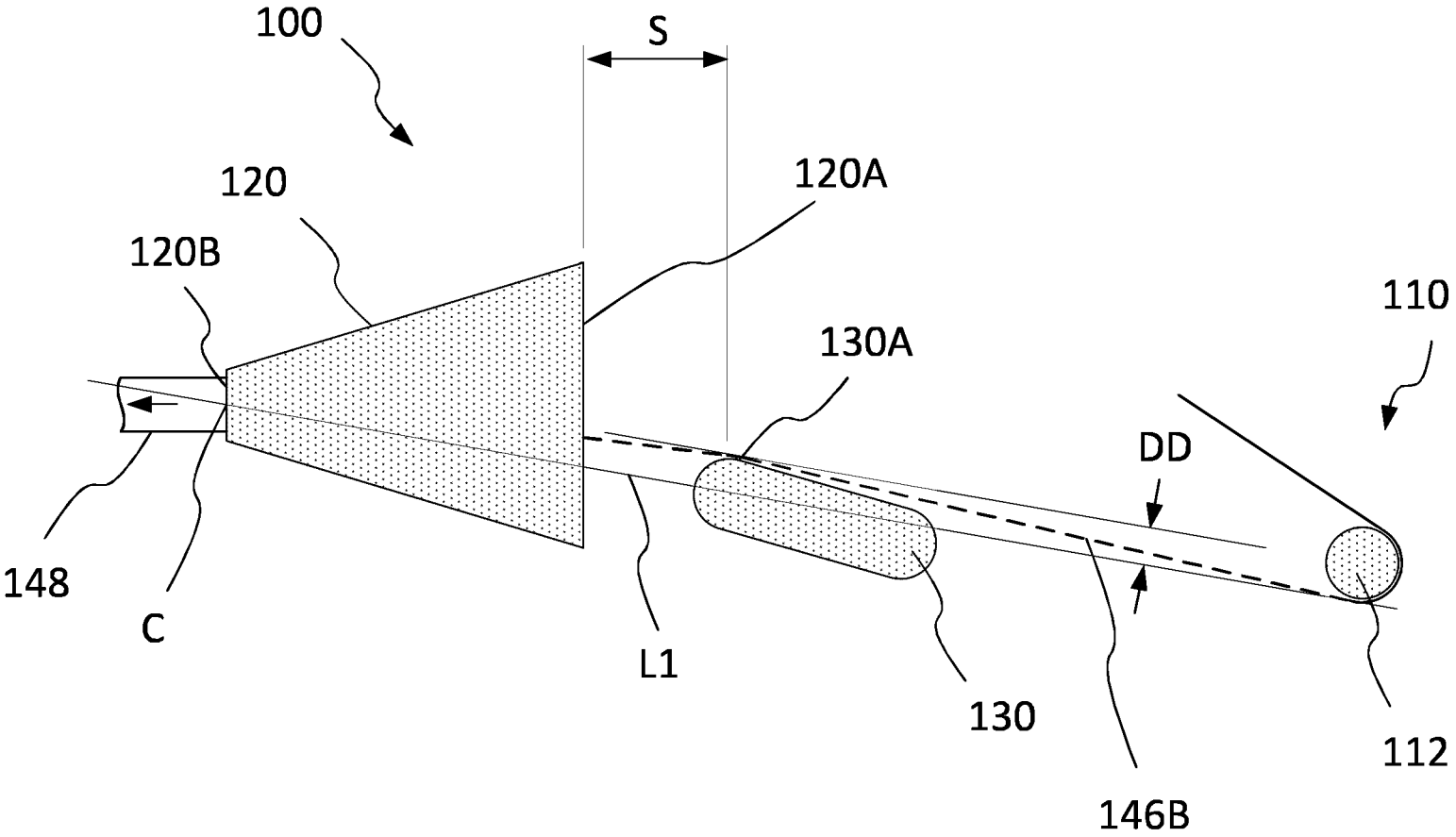
FIGS. 1C and 1D show further side views of part of the first folding apparatus of FIG. 1A.

The portion of the web 140 into which the peak of the curved central ridge 146B is introduced deflects by a deflection distance DD, with respect to a line L1 extending between where the web leaves the supply apparatus 110 (e.g. the underside of guide roller 112) and the centre C of the narrow outlet 120B of the folding funnel 120, as shown in FIG. 1C. The deflection distance DD (measured perpendicularly to the line L1) may be a deflection of between 20 mm to 60 mm. The minimal deflection distance enables consistent introduction of the curved central ridge 146B. The maximal deflection distance minimises local heating and distortion (e.g. avoids excessive local heating and distortion) of the web as it flows across the web-contacting surface of the former.

In the folding apparatus 100 illustrated in FIG. 1A, a former 130 is provided having a fixed location relative to the folding funnel 120, providing a fixed deflection distance DD of the central portion of the web 140 as it is drawn across the former. Alternatively, the former may be adjustably mounted with respect to the folding funnel (not shown), enabling the deflection distance DD to be adjusted in accordance with operational requirements, for example with the deflection distance DD being chosen in correspondence with different web materials. Additionally, adjustment of the former may facilitate setting-up of a folding apparatus, for example when a replacement web material is threaded through the folding apparatus.

The former 130 may have a length of 40 mm to 150 mm, or may have a length of 50_mm to 100 mm. The web-contacting surface 130A of the former 130 may have a radius of curvature of 25 mm.

Figure 1D:
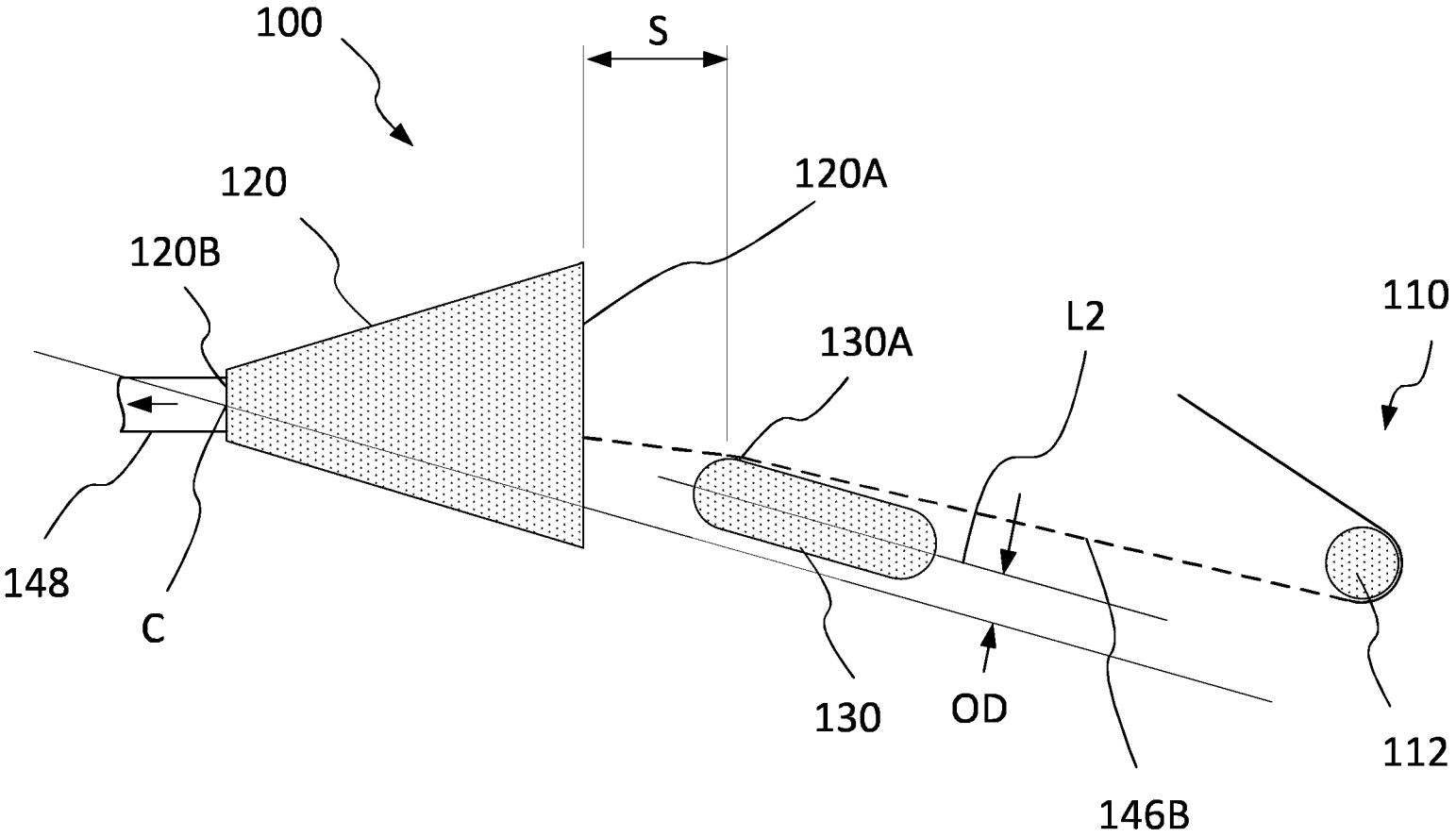

The arrangement of the folding apparatus 100 may alternatively be specified with respect to the relative orientation of the former 130 and the centre C of the narrow outlet 120B of the folding funnel 120, as shown in FIG. 1D. In the case that the former 130 is an elongate body having a centre line L2, the centre line L2 of the former may be offset from the centre C of the narrow outlet 120B of the folding funnel 120 by an offset distance OD. The offset distance OD may be 10 mm to 20 mm.

In FIG. 1B, the illustrated relative positioning of the funnel 120, former 130 and supply apparatus 110 produces the curved W-shaped cross-sectional shape of the web 140 with the curved central ridge 146B projecting upwardly. However, the funnel, former and supply apparatus may have a different relative positioning that produces the curved W-shaped cross-sectional shape of the web with a different orientation, for example having the curved central ridge projecting downwardly, as an inverted curved W-shape (that is, a curved M-shape), or having the curved central ridge projecting laterally (e.g. a curved E-shape or like a curved 3-shape).

The introduction of the curved central ridge 146B into the web 140 by the former 130 stabilises the position of the web relative to the funnel 120, as it is drawn into the mouth 120A of the funnel. The introduction of the curved central ridge 146B stabilises the width-wise cross-sectional shape of the web 140 as the web comes into contact with the inner surface 120C of the funnel 120. Stabilisation of the web may increase the consistency with which the web is folded within the folding funnel 120, as it is pleated to form the compressed rod 148 that is drawn out through the narrow outlet 120B of the folding funnel.

Deflection of the web 140 across the former 130 enables enhanced folding performance whilst only introducing a minimal level of additional friction into the flow of the web. The sliding contact between the former 130 and the web 140 is smoothly distributed across a single, broad, convexly-shaped web-contacting surface 130A of the former, with the breadth of the contact area minimising localised heating and thermal damage to the web.

The illustrated former 130 has an elongate cylindrical shape extending smoothly into curved ends.

The former 130 is located proximate to the mouth 120A of the funnel 120. In the folding apparatus 100 of FIG. 1A, the web-contacting surface 130A of the former 130 is spaced apart from, and outside, the funnel 120 by a separation S, as shown in FIG. 1C, and the separation S may be 20_mm to 200_mm. Alternatively, the separation S may be 30_mm to 150_mm. The proximity of the web-contacting surface of the former 130 to where the web 140 comes into contact with the inner surface 120C of the funnel 120 provides stability in the flow of the web between the former 130 and contacting the inner surface of the funnel.

The web-contacting surface 130A of the former 130 may be provided with a textured friction-reduction surface (not shown), for example a pattern of ridges extending substantially parallel to the direction of travel of the web, in use.

In the first folding apparatus 100, the funnel 120 and former 130 are separately mounted 122, 132 on a base 124. The former 130 may be provided with a cooling apparatus (not shown), for example being provided with a thermoelectric cooler (Peltier cooler) or being provided with a cooling water supply. Alternatively, or additionally, the former 130 may be provided with a plurality of air supply apertures through which air may be supplied between the former and the web 140, which may cool the former and web, and may reduce friction between the former and web.

The folding apparatus typically forms a sub-assembly within a complete manufacturing apparatus for the production of products for aerosol-generating articles or for producing aerosol-generating articles. The complete manufacturing apparatus may comprise tensioning mechanisms, web drive mechanisms for drawing the web through the funnel, and wrapping mechanisms for wrapping the rod of compressed web that passes out of the funnel, and a cutting mechanism for cutting the rod into lengths.

Although in the first folding apparatus 100 of FIG. 1A, the web-contacting surface 130A of the former 130 is outside the funnel 120, alternatively the web-contacting surface may be provided within the funnel, by providing the former within the funnel or by providing a former that extends in through the mouth of the funnel.

Figure 2:
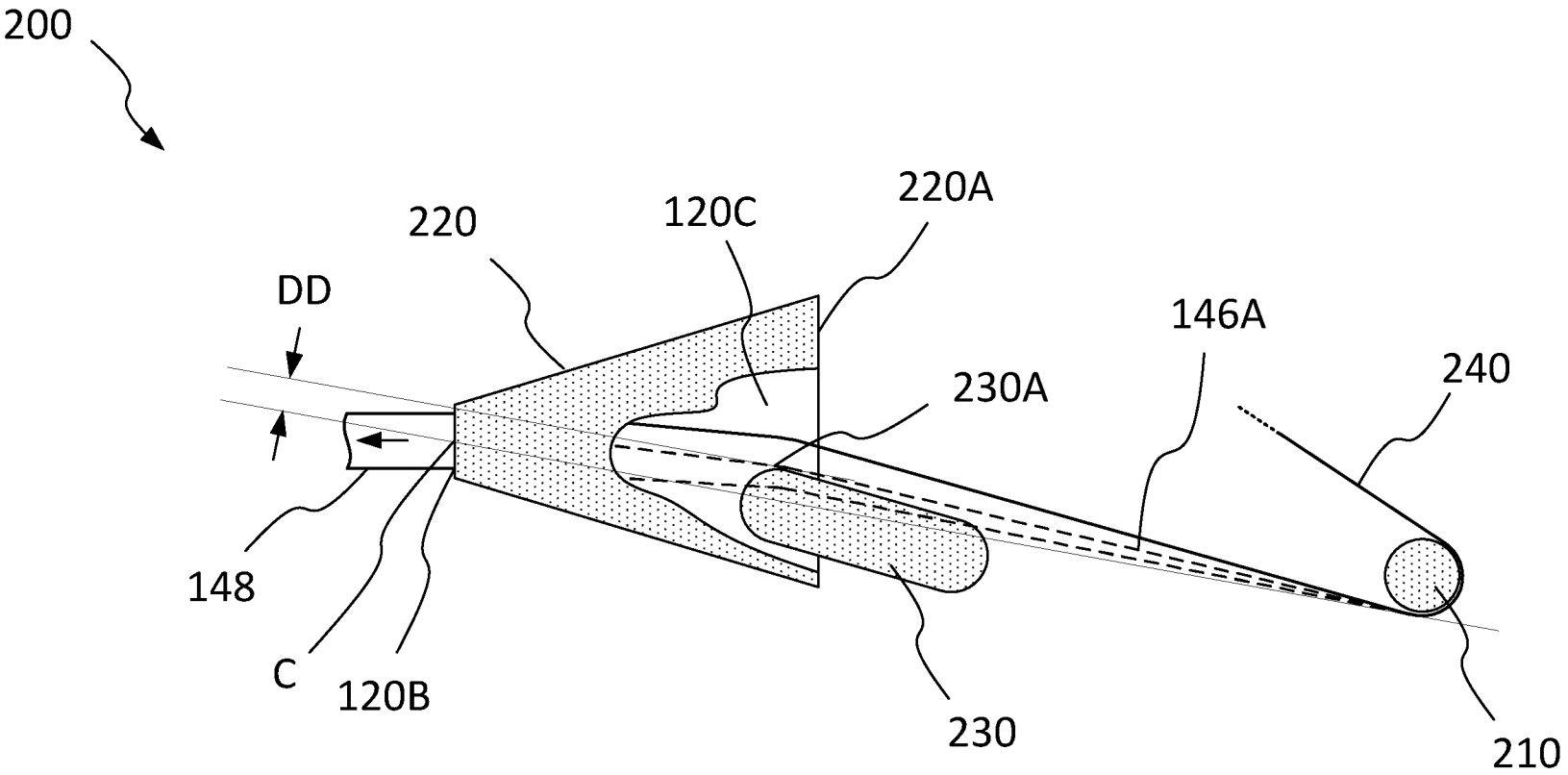
FIG. 2 shows a partially cut-away side view of a second folding apparatus.

FIG. 2 shows a partially cut-away side view of a second folding apparatus 200 for folding a web 240 into a rod-shape, having a supply apparatus 210 (indicated only by a guide roller), a rod-forming funnel 220 and a former 230, for folding a web of material 240. The method of use of the second folding apparatus 200 corresponds to that of the first folding apparatus 100, with the web 240 being drawn across a web-contacting surface 230A of the former 230, introducing a curved central ridge 246B into the web. The second folding apparatus 200 differs from that of the first folding apparatus 100 by the former 230 extending into the mouth 220A of the funnel 220, providing the web-contacting surface 230A within the funnel, which may enhance web stability in use.

The former 230 is located proximate the mouth 220A of the funnel 220. In the folding apparatus 200 of FIG. 2, the web-contacting surface 230A of the former 230 extends within the funnel 220.

Figure 3:
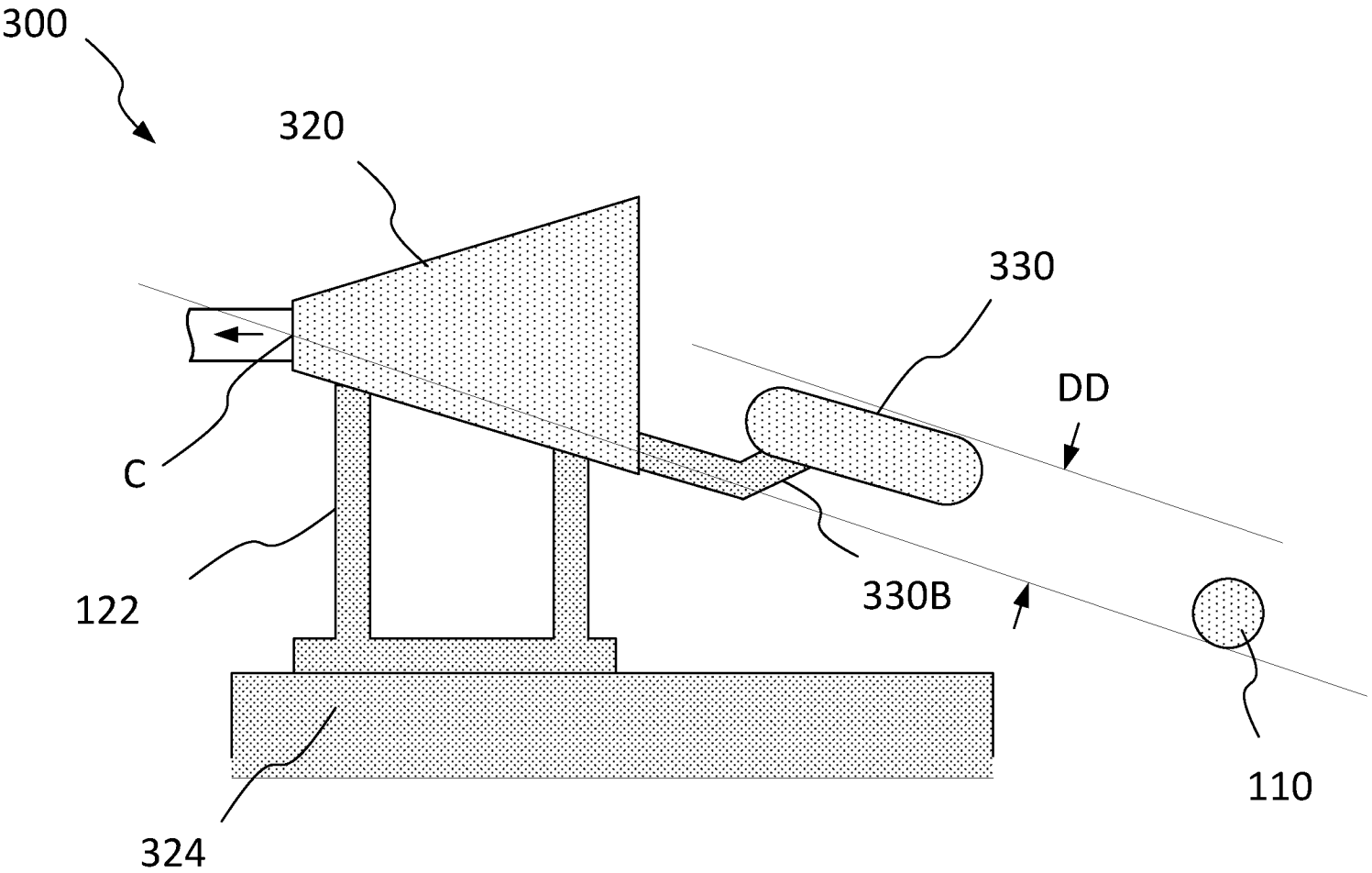
FIG. 3 shows a side view of part of a third folding apparatus.

Although in the first folding apparatus 100, the funnel 120 and former 130 are separately mounted 122, 132 on a base 124, alternatively, as shown in the third folding apparatus 300 of FIG. 3, the former 330 may project from the funnel 320, for example vbeing mounted directly to the funnel by an arm 330B. This arrangement may simplify servicing of the folding apparatus, by enabling both the funnel 320 and former 330 to be removed from the base 324 as a single piece.

Although in the previously described folding apparatuses 100, 200, 300 the illustrated formers have an elongate cylindrical shape extending smoothly into curved ends, the former is not limited to that shape.

Figure 4:
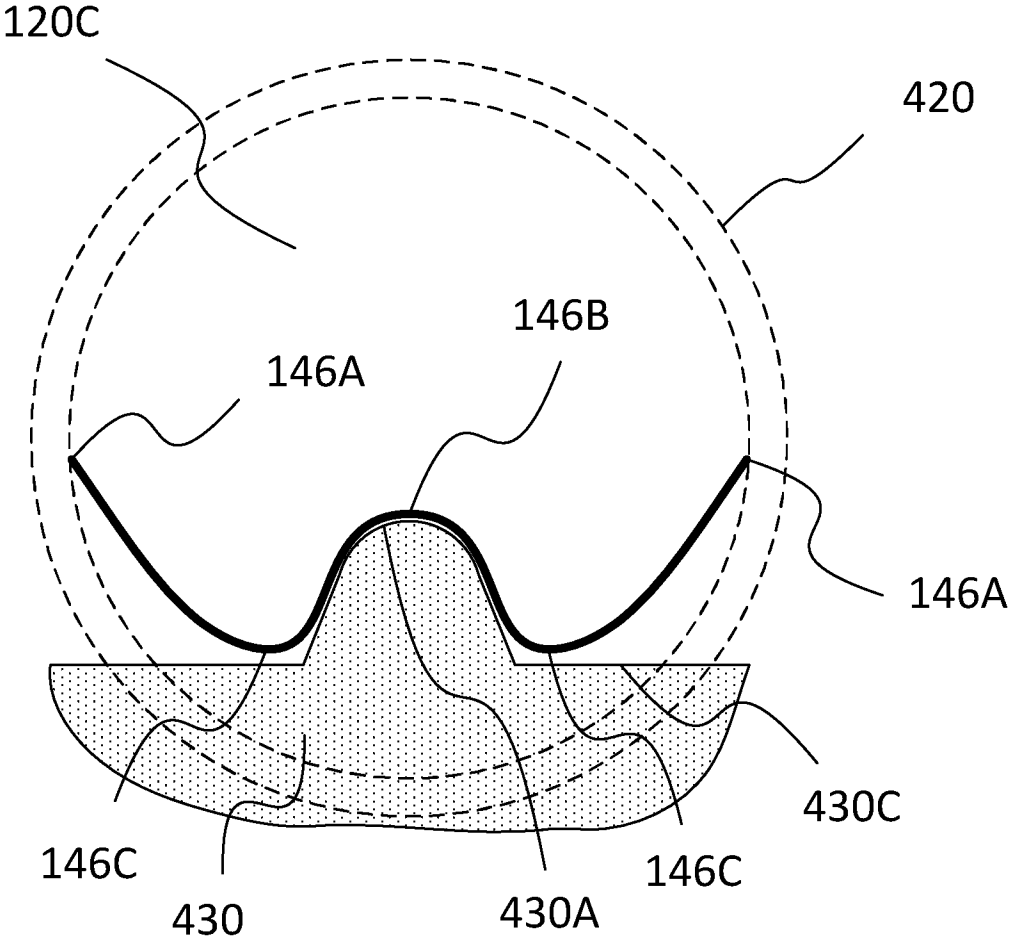
FIG. 4 shows a cross-sectional view through a fourth folding apparatus.

FIG. 4 illustrates a cross-sectional view through a differently-shaped former 430 (otherwise corresponding to the cross-sectional view of FIG. 1B) in which the web-contacting surface 430A is provided on a projection from a face of a larger body 430C, having a smoothly-shaped convex extremity of the projection (which may additionally be provided with a textured surface, as described previously). This arrangement may facilitate manufacture of the former 430, and provide the former with a greater mass, stabilising the former against vibration. The web-contacting surface 430A of the former 430 may have a radius of curvature of 25_mm.

Figure 5:
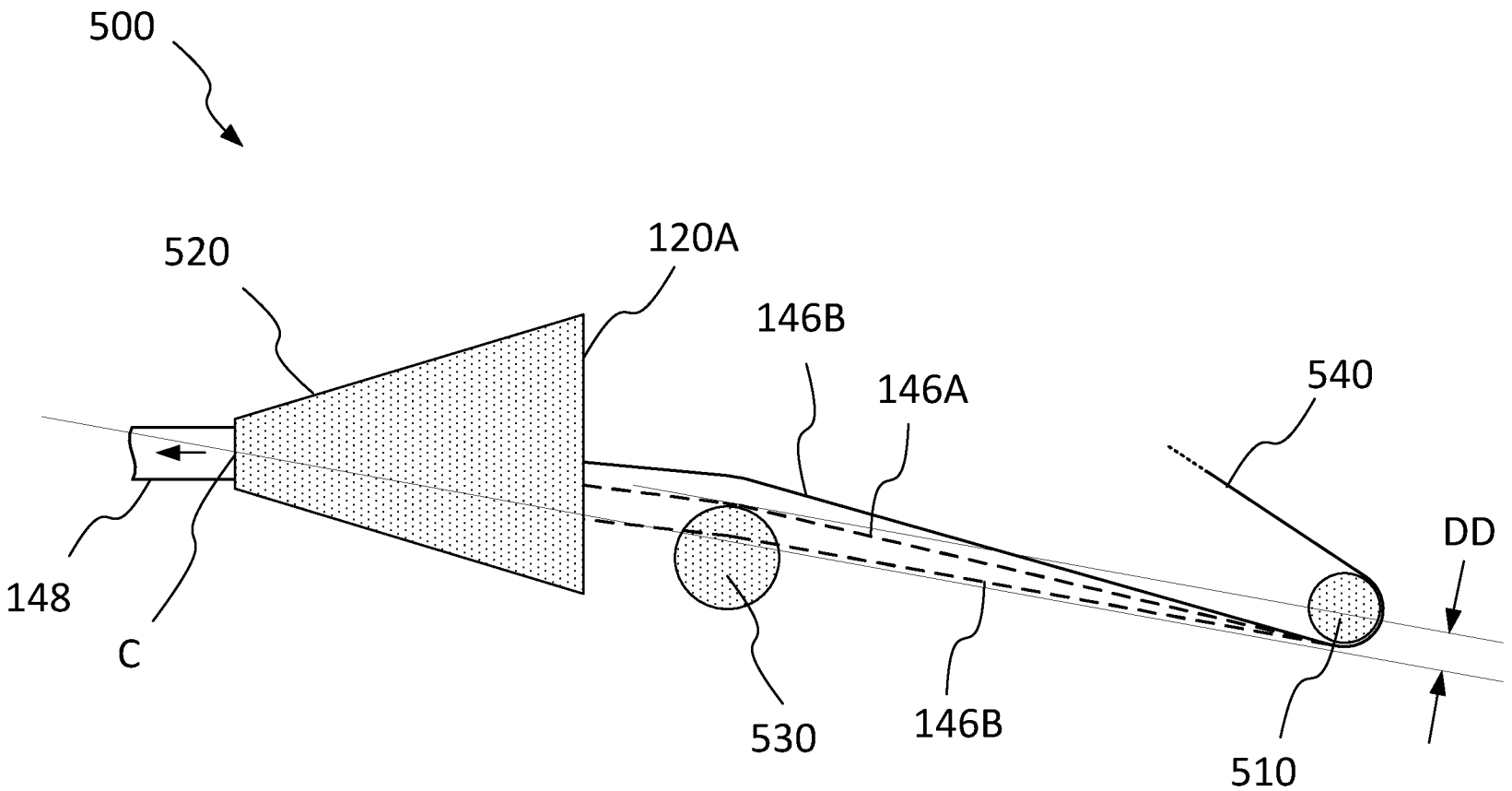
FIG. 5 shows a side view of a fifth folding apparatus.

FIG. 5 illustrates a side view of a further shape of former 530, which is substantially spherical. The mounting arrangement is omitted, and may correspond with the mounting arrangement of FIG. 1A or FIG. 3. The substantially spherical shape of the former 530 may facilitate the provision of a compact folding apparatus 500, enabling the separation between the supply apparatus 510 and the funnel 520 to be reduced, further enhancing stability of the intervening flow of web 540. The spherical former 530 may have a diameter of 50_mm (i.e. a radius of curvature of 25_mm).

As discussed in relation to the folding apparatus of FIG. 1A, the formers 230, 330, 430 and 530 of FIGS. 2, 3, 4 and 5 may be adjustable mounted to their respective folding funnels 220, 320, 420 and 520, enabling adjustment of the deflection distance DD (or similarly enabling adjustment of the offset distance OD).

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method of pleating a web material to form a compressed rod of pleated web material for a filter rod of an aerosol-generating article, comprising:

supplying a feed of web material from a supply apparatus;

drawing the web material through a filter rod manufacturing apparatus;

introducing a curved ridge into a central portion of a width wise cross-section of the web material as it approaches contact with an interior of a folding funnel, by drawing the web material across a forming surface of a former before the web material enters the folding funnel, wherein the forming surface contacts a central portion of the web material, in which the forming surface deflects the central portion of the web material from a line extending between where the web material leaves the supply apparatus and a center of an outlet of the folding funnel; and pleating the web material in the folding funnel to form a compressed rod of pleated web material; and, wherein the forming surface is provided with a textured surface.

2. The method of claim 1, wherein the web material is deflected by a deflection distance of 20 mm to 60 mm, at a peak of the curved central ridge, where the web material passes over the forming surface.

3. The method of claim 1, wherein relative positions of the former and folding funnel are adjustable for adjusting a deflection distance of the web material.

4. The method of claim 1, wherein the forming surface is located 20 mm to 200 mm from a mouth of the folding funnel.

5. The method of claim 1, wherein the former extends into a mouth of the folding funnel.

6. The method of claim 1, wherein the textured surface is a plurality of ridges extending along a direction of travel of the web material.

7. The method of claim 1, wherein the former is provided with a temperature control mechanism.

8. The method of claim 1, wherein the forming surface is provided with a plurality of air supply holes.

9. The method of claim 1, wherein a curved W-shape is produced in the web material where it is drawn across the former.

10. The method of claim 1, wherein the central portion of a width-wise cross-section of the web material is a central 50% of the width of the web material.

11. A method of manufacturing a filter rod for an aerosol-generating article, comprising the method of manufacturing a compressed rod of claim 1, and wrapping the compressed rod of pleated web material within a tube of wrapping paper.

* * * * *